US006813892B1

(12) United States Patent
Olson et al.

(10) Patent No.: US 6,813,892 B1
(45) Date of Patent: Nov. 9, 2004

(54) CRYOCOOLER WITH MULTIPLE CHARGE PRESSURE AND MULTIPLE PRESSURE OSCILLATION AMPLITUDE CAPABILITIES

(75) Inventors: Jeffrey R. Olson, San Mateo, CA (US); Patrick J. Champagne, Portola Valley, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/449,747

(22) Filed: May 30, 2003

(51) Int. Cl.[7] ..... F25B 9/00; F25B 7/00
(52) U.S. Cl. ..... 62/6; 62/335
(58) Field of Search ..... 62/6, 335

(56) References Cited

U.S. PATENT DOCUMENTS

| | | | | | |
|---|---|---|---|---|---|
| 3,237,421 | A | | 3/1966 | Gifford | 62/88 |
| 4,926,647 | A | | 5/1990 | Dorri et al. | 62/51.1 |
| 5,022,229 | A | | 6/1991 | Vitale | 62/6 |
| 5,107,683 | A | * | 4/1992 | Chan et al. | 62/6 |
| 5,317,878 | A | | 6/1994 | Bradshaw et al. | 62/6 |
| 5,513,498 | A | | 5/1996 | Ackermann et al. | 62/51.1 |
| 5,647,218 | A | * | 7/1997 | Kuriyama et al. | 62/6 |
| 5,647,219 | A | | 7/1997 | Rattray et al. | 62/6 |
| 5,711,156 | A | * | 1/1998 | Matsui et al. | 62/6 |
| 6,202,422 | B1 | | 3/2001 | Chazot et al. | 62/51.2 |
| 6,230,499 | B1 | * | 5/2001 | Hohne | 62/6 |
| 6,256,998 | B1 | | 7/2001 | Gao | 62/6 |
| 6,327,862 | B1 | | 12/2001 | Hanes | 62/6 |
| 6,330,800 | B1 | | 12/2001 | Price et al. | 62/6 |
| 6,374,617 | B1 | | 4/2002 | Bonaquist et al. | 62/6 |
| 6,644,038 | B1 | * | 11/2003 | Acharya et al. | 62/6 |
| 2001/0032469 | A1 | * | 10/2001 | Zhu et al. | 62/6 |

* cited by examiner

*Primary Examiner*—William C. Doerrler
(74) *Attorney, Agent, or Firm*—Marsh Fischmann & Breyfogle LLP

(57) ABSTRACT

A pulse tube cryocooler (90) is disclosed having a second cryocooler section (94*b*) with a single pulse tube stage (35*c*), and having a first cryocooler section (94*a*) with a pair of pulse tube stages (35*a*, 35*b*). A first pressure oscillator (98*a*) is associated with the first cryocooler section (94*a*), while a second pressure oscillator (98*b*) is associated with the second cryocooler section (94*b*). The first cryocooler section (94*a*) and the second cryocooler section (94*b*) are fluidly isolated from each other. Therefore, the charge pressure, the pressure amplitude, oscillation frequency, and working gas in each of the first cryocooler section (94*a*) and the second cryocooler section (94*b*) may be independently selected/established.

50 Claims, 3 Drawing Sheets

CRYOCOOLER WITH MULTIPLE CHARGE PRESSURE AND MULTIPLE PRESSURE OSCILLATION AMPLITUDE CAPABILITIES

FIELD OF THE INVENTION

The present invention generally relatives to the field of cryocoolers having multiple cryocooler sections and, more particularly, to allowing for the use of one charge pressure source and pressure oscillator for one cryocooler section, and for the use of at least one other charge pressure source and pressure oscillator for a different cryocooler section.

BACKGROUND OF THE INVENTION

Various configurations of pulse tube cryocoolers are known for providing cooling in a number of applications. Pulse tube cryocoolers may provide cooling for electronics and the like on board extraterrestrial spacecraft. One way to categorize pulse tube cryocoolers is in relation to the number of stages that are utilized. Single stage pulse tube cryocoolers are typically operated at a comparatively high pressure for operating efficiency purposes, and can provide cooling down to about 60 K. Multiple stage pulse tube cryocoolers arranged in series (generally, where one pulse tube stage "precools" another pulse tube stage) are usually required to realize cooling temperatures of 50 K or below. These multi-stage types of pulse tube cryocoolers are typically operated at lower pressures than the above-noted single stage pulse tube cryocoolers in order to realize a desired operating efficiency.

There are pulse tube cryocooler designs having what may be characterized as multiple cryocooler sections. For instance, a first cryocooler section may include a single pulse tube stage, while a second cryocooler section may include multiple pulse tube stages. The first cryocooler section may provide precooling for the second cryocooler section in this type of design. However, the first and second cryocooler sections utilize a common charge pressure. Therefore, it should be appreciated that using this type of pressure source may not allow the first and second cryocooler sections to each operate at a desired efficiency since both the first and second cryocooler sections will be charged at the same mean pressure. Both the first and second cryocooler sections are also exposed to the same pressure oscillation in known designs. This common pressure oscillator may be in the form of a dual-piston compressor. Compressors of this type utilize what may be characterized as opposing pistons in a common compression space. Each piston is operated at the same frequency by the same drive. However, the pistons are moved through the common compression space in opposite directions to reduce vibrations. Therefore, it should be appreciated that using this type of pressure oscillator may not allow the first and second cryocooler sections to each operate at a desired efficiency since both the first and second cryocooler sections will undergo the same pressure oscillation.

BRIEF SUMMARY OF THE INVENTION

A first aspect of the present invention is generally directed to a cryocooler. This cryocooler includes at least two separate cryocooler sections (hereafter first and second cryocooler sections, although more cryocooler sections could of course be utilized). The first cryocooler section includes at least two stages, each having at least one pulse tube (hereafter first and second stages), while the second cryocooler section includes at least one stage, each having at least one pulse tube (hereafter a second cryocooler section first stage). Pressure oscillations for the first and second cryocooler sections are generated by a first pressure oscillator that is fluidly interconnected with the first cryocooler section and a second pressure oscillator that is fluidly interconnected with the second cryocooler section. The first pressure oscillator does not generate a pressure oscillation within the second cryocooler section. Similarly, the second pressure oscillator does not generate a pressure oscillation within the first cryocooler section. Stated another way, the first pressure oscillator is not fluidly interconnected with the second cryocooler section, and the second pressure oscillator is not fluidly interconnected with the first cryocooler section. Stated yet another way, the first and second cryocooler sections are fluidly isolated from each other. This then allows the charge pressures in the first and second cryocooler sections to be selected/established independently of each other. That is, the charge pressure that may be used in the first cryocooler section need not be dependent upon the charge pressure that is used in the second cryocooler section, and vice versa. Although the first and second cryocooler sections will typically each be charged with a gas, the first aspect also encompasses using any appropriate fluid. Hereafter, references will be made to having a fluid or a working fluid in the first and second cryocooler sections, each of which are closed systems.

Various refinements exist of the features noted in relation to the first aspect of the present invention. Further features may also be incorporated in the first aspect of the present invention as well. These refinements and additional features may exist individually or in any combination. Any configuration/size/type of stage may be utilized by the first and second cryocooler sections, and including having its components (e.g., one or more regenerators, one or more heat exchangers, one or more pulse tubes, one or more flow impedance devices) being of any appropriate configuration/size/type and disposed in any appropriate relative arrangement. For instance, one or more of the stages may be of the inertance-type (having an inertance tube that interfaces with one end of a pulse tube that is opposite the end of this pulse tube that interfaces with a coldhead, where the inertance tube is disposed between a fluid reservoir and this pulse tube). One or more of the stages also may be of the orifice-type (having an orifice in a fluid line that interfaces with one end of a pulse tube that is opposite the end of this pulse tube that interfaces with a coldhead, where the orifice is disposed between a fluid reservoir and this pulse tube). Any type of flow impedance device (e.g., an orifice, valve, porous plug, inertance tube, vortex tube) may be used in conjunction with each stage of the cryocooler of the first aspect. Each stage will typically have only a single pulse tube, although a stage having multiple pulse tubes would be encompassed by this first aspect.

The first cryocooler section in the case of the first aspect may be characterized as a multi-stage side of the cryocooler (e.g., the first and second stages), while the second cryocooler section may be in the form of a single stage side of the cryocooler (i.e., the second cryocooler section first stage). Such a first stage for the first cryocooler section may include a first regenerator, a first pulse tube, and first, second, and third heat exchangers. The first pressure oscillator is fluidly interconnected with the first stage, the first heat exchanger may be associated with a first part of the first regenerator (e.g., a first hot end heat exchanger), the second heat exchanger may be associated with both a second part of the first regenerator and a first part of the first pulse tube (e.g., a first cold end heat exchanger), and the third heat exchanger may be associated with a second part of the first pulse tube (e.g., a first pulse tube heat exchanger). Similarly, such a second stage for the first cryocooler section may include a second regenerator, a second pulse tube, and fourth, fifth, and sixth heat exchangers. The first pressure oscillator is also fluidly interconnected with the second stage, the first stage may precool the second stage, the fourth heat exchanger may be associated with a first part of the second regenerator (e.g., a second hot end heat exchanger), the fifth heat exchanger may be associated with both a second part of the second regenerator and a first part of the second pulse tube (e.g., a second cold end heat exchanger), and the sixth heat exchanger may be associated with a second part of the second pulse tube (e.g., a second pulse tube heat exchanger). Finally, such a second cryocooler section first stage may include a third regenerator, a third pulse tube, and seventh, eighth, and ninth heat exchangers. The second pressure oscillator is fluidly interconnected with the second cryocooler section first stage, the seventh heat exchanger may be associated with a first part of the third regenerator (e.g., a third hot end heat exchanger), the eighth heat exchanger may be associated with both a second part of the third regenerator and a first part of the third pulse tube (e.g., a third cold end heat exchanger), and the ninth heat exchanger may be associated with a second part of the third pulse tube (e.g., a third pulse tube heat exchanger). Each of these heat exchangers may be of any appropriate type/configuration.

An appropriate heat transfer link may be provided in any appropriate manner between the first heat exchanger of the above-described first stage of the first cryocooler section and the seventh heat exchanger of the above-described second cryocooler section first stage in the case of the first aspect. Although this will typically be through conductive heat transfer (e.g., where the first heat exchanger and seventh heat exchanger are mounted on a common flange, plate, or the like; where the first heat exchanger and seventh heat exchanger are connected by a copper rope), convective heat transfer techniques or a combination of convective and conductive heat transfer techniques could be utilized as well. An appropriate heat transfer link may also be provided in any appropriate manner between the second heat exchanger of the above-described first stage of the first cryocooler section and the eighth heat exchanger of the above-described second cryocooler section first stage. Although this will typically be through conductive heat transfer (e.g., where the second heat exchanger and eighth heat exchanger are mounted on a common flange, plate, or the like; where the second heat exchanger and eighth heat exchanger are connected by a copper rope), convective heat transfer techniques or a combination of convective and conductive heat transfer techniques could be utilized as well. Both of these heat exchanger pairs may also be thermally connected by conductive heat transfer in any appropriate manner as well (i.e., a combination of the foregoing).

The first pressure oscillator and the second pressure oscillator may generate a common pressure oscillation or different pressure oscillations in their corresponding first and second cryocooler sections in the case of the first aspect. First and second charge pressures may be used in the first and second cryocooler sections, and these may be of the same magnitude or of different magnitudes. The same or a different fluid pressure amplitude may be generated in the first and second cryocooler sections via operation of the first and second pressure oscillators, respectively. The same fluid types or different fluid types (e.g., the same or different working fluid) may be used in the first and second cryocooler sections as well. Any combination of the various options presented in this paragraph may be utilized as well.

The first and second pressure oscillators utilized by the cryocooler of the first aspect may be in the form of separate compressors (e.g., first and second compressors). One option would be to run the first and second compressors at the same or a common frequency. Another option would be run the first and second compressors at different frequencies. The above-noted options with regard to charge pressures, fluid pressure amplitudes, and fluid types may of course be used with one or both of these two options as well.

The first and second pressure oscillators utilized by the cryocooler of the first aspect may also be in the form of a single compressor that is "split," for instance into a high-pressure side and a low-pressure side. Such a compressor may include first and second pistons, as well as first and second compression spaces that are fluidly isolated from each other. The first and second pistons may be interconnected with a common control system (e.g., a common controller or control electronics) that at least operatively interfaces with each of the first and second pistons. For instance, this common control system or controller may interface with a first motor for moving the first piston, as well as with a second motor for moving the second piston. In any case, the first piston is advanced through the first compression space to generate a pressure oscillation in the first cryocooler section. Similarly, the second piston is advanced through the second compression space to generate a pressure oscillation in the second cryocooler section. A single piston (the first piston) may be advanced through the first compression space, while a single piston (the second piston) may be advanced through the second compression space to provide pressure oscillations in the first and second cryocooler sections. In one embodiment, the first and second pistons are disposed in opposing relation (for movement along a common axis) and are moved in opposite directions to reduce vibration of the compressor. Moreover, in one embodiment, a low-pressure side of this split compressor interacts with the first cryocooler section, while a high-pressure side of the split compressor interacts with the second cryocooler section.

The first and second cryocooler sections may be "thermally connected" in any appropriate manner in the case of the first aspect. Consider the case where the first cryocooler section includes first and second stages each having a pulse tube, and where the first stage of the first cryocooler section precools the second stage of the first cryocooler section. The second cryocooler section first stage may not only provide cooling to a particular cooling load, but may also provide precooling for the second stage of the first cryocooler section. Stated another way, the second cryocooler section first stage may assist the first stage of the first cryocooler section to pre-cool the second stage of the first cryocooler section.

There are a number of advantages associated with the arrangement contemplated by the first aspect. Any number of parameters may be independently selected in relation to both the first and second cryocooler sections to achieve a desired result. For instance, the first cryocooler section may be operated so as to provide cooling over a first temperature range (including both at a single temperature, but more likely over a range of temperatures) and the second cryocooler section may be operated so as to provide cooling over a second temperature range (including both a single temperature, but more likely over a range of temperatures) that is different from the first temperature range. In one embodiment, the first cryocooler section provides cooling to a lower temperature than the second cryocooler section (e.g., the first cryocooler section may provide cooling at a lower temperature to a cooling load than the second cryocooler section provides cooling to a different cooling load). The second cryocooler section also may be operated at a higher charge pressure than the first cryocooler section, for instance such that both the first and second cryocooler sections may operate at a more desired efficiency. More generally, the first cryocooler section and the second cryocooler section may be operated at one or more of a different charge pressure, a different pressure amplitude, a different pressure oscillation frequency, using a different working fluid, or any combination thereof (i.e., each of these four parameters may be independently selected for both the first and second cryocooler sections). The flexibility provided by using separate fluid volumes (e.g., first and second cryocooler sections that are fluidly isolated from each other) may be applicable to any pulse tube stage configuration of any kind.

A second aspect of the present invention is generally directed to a cryocooler having at least two separate cryocooler sections (hereafter first and second cryocooler sections, although more cryocooler sections could of course be utilized). Another component of the cryocooler is a single compressor. This compressor includes first and second pistons, as well as first and second compression spaces that are fluidly isolated from each other. The first piston is advanced through the first compression space to interact with fluid in the first cryocooler section (typically a gas, although the second aspect encompasses having any appropriate fluid in the first cryocooler section). Similarly, the second piston is advanced through the second compression space to interact with fluid in the second cryocooler section (typically a gas, although the second aspect encompasses any appropriate fluid in the second cryocooler section).

Various refinements exist of the features noted in relation to the second aspect of the present invention. Further features may also be incorporated in the second aspect of the present invention as well. These refinements and additional features may exist individually or in any combination. Both the first and second cryocooler sections may be in the form of a closed system. There are a number of characterizations relating to the single "split" configuration for the compressor contemplated by the second aspect. The first and second pistons may be interconnected with a common control system (e.g., a common controller or control electronics). In one embodiment, this common control system at least operatively interfaces with each of the first and second pistons. For instance, this common control system may interface with a first motor for moving the first piston, as well as with a second motor for moving the second piston. Another characterization of the single "split" configuration for the compressor is that a single piston (the first piston) advances through the first compression space and provides the pressure oscillation within the first cryocooler section, while a single piston (the second piston) advances through the second compression space and provides the pressure oscillation within the second cryocooler section. The first and second pistons in this case are preferably disposed in opposing relation (for movement along a common axis) and move/advance in opposite directions to reduce vibrations.

The first and second cryocooler sections used by the second aspect each may be of any appropriate configuration/size/type (e.g., a Stirling-type cryocooler, a pulse tube-type cryocooler; a hybrid combination of pulse tube and Stirling stages). One or both of the first and second cryocooler sections each may also be at least one stage, each of which has at least one pulse tube. Any configuration/size/type of stage may be utilized by the first and second cryocooler sections in the case of the second aspect, including having its individual components being of any appropriate configuration/size/type and disposed in any appropriate relative arrangement. For instance, any pulse tube stage used by the second aspect may be of the inertance-type (having an inertance tube that interfaces with one end of a pulse tube that is opposite the end of this pulse tube that interfaces with a coldhead, where the inertance tube is disposed between a fluid reservoir and this pulse tube). Any pulse tube stage used by the second aspect also may be of the orifice-type (having an orifice in a fluid line that interfaces with one end of a pulse tube that is opposite the end of the pulse tube that interfaces with a coldhead, where the orifice is disposed between a fluid reservoir and this pulse tube). Generally, any type of flow impedance device may be utilized by any pulse tube stage that is utilized by the second aspect (e.g., an orifice, valve, porous plug, inertance tube, vortex tube).

Consider the case where the first and second cryocooler sections of the cryocooler of the second aspect each include at least one stage, each having at least one pulse tube. The first cryocooler section in the case of the second aspect may be characterized as a multi-stage side of the cryocooler (e.g., first and second stages), while the second cryocooler section may be in the form of a single stage side of the cryocooler (i.e., a second cryocooler section first stage). Such a first stage for the first cryocooler section may include a first regenerator, a first pulse tube, and first, second, and third heat exchangers. The first compression space and first piston interact with the fluid within the first stage, the first heat exchanger may be associated with a first part of the first regenerator (e.g., a first hot end heat exchanger), the second heat exchanger may be associated with both a second part of the first regenerator and a first part of the first pulse tube (e.g., a first cold end heat exchanger), and the third heat exchanger may be associated with a second part of the first pulse tube (e.g., a first pulse tube heat exchanger). Similarly, such a second stage for the first cryocooler section may include a second regenerator, a second pulse tube, and fourth, fifth, and sixth heat exchangers. The first compression space and first piston also interact with the fluid within the second stage, the first stage of the first cryocooler section may precool the second stage of the first cryocooler section, the fourth heat exchanger may be associated with a first part of the second regenerator (e.g., a second hot end heat exchanger), the fifth heat exchanger may be associated with both a second part of the second regenerator and a first part of the second pulse tube (e.g., a second cold end heat exchanger), and the sixth heat exchanger may be associated with a second part of the second pulse tube (e.g., a second pulse tube heat exchanger). Finally, such a second cryocooler section first stage may include a third regenerator, a third pulse tube, and seventh, eighth, and ninth heat exchangers. The second compression space and second piston interact with the fluid in the second cryocooler section first stage, the seventh heat exchanger may be associated with a first part of the third regenerator (e.g., a third hot end heat exchanger), the eighth heat exchanger may be associated with both a second part of the third regenerator and a first part of the third pulse tube (e.g., a third cold end heat exchanger), and the ninth heat exchanger may be associated with a second part of the third pulse tube (e.g., a third pulse tube heat exchanger). Each of these heat exchangers may be of any appropriate type/configuration. In one embodiment, a low-pressure side of the split compressor of the second aspect interacts with the first cryocooler section, while a high-pressure side of this split compressor of the second aspect interacts with the second cryocooler section.

An appropriate heat transfer link may be provided in any appropriate manner between the first heat exchanger of the above-described first stage of the first cryocooler section and the seventh heat exchanger of the above-described second cryocooler section first stage in the case of the second aspect. Although this will typically be through conductive heat transfer (e.g., where the first heat exchanger and seventh heat exchanger are mounted on a common flange, plate, or the like; where the first heat exchanger and seventh heat exchanger are connected by a copper rope), convective heat transfer techniques or a combination of convective and conductive heat transfer techniques could be utilized as well. Conductive heat transfer may also be provided in any appropriate manner between the second heat exchanger of the above-described first stage of the first cryocooler section and the eighth heat exchanger of the above-described second cryocooler section first stage. Although this will typically be through conductive heat transfer (e.g., where the second heat exchanger and eighth heat exchanger are mounted on a common flange, plate, or the like; where the second heat exchanger and eighth heat exchanger are connected by a copper rope), convective heat transfer techniques or a combination of convective and conductive heat transfer techniques could be utilized as well. Both of these heat exchanger pairs may also be thermally connected by an appropriate heat transfer link in any appropriate manner as well (i.e., a combination of the foregoing).

The first piston and first compression space of the compressor may be characterized as a first pressure oscillator, while the second piston and second compression space of the compressor may be characterized as a second pressure oscillator. The first pressure oscillator and the second pressure oscillator may generate a common fluid pressure oscillation or a different fluid pressure oscillation in their corresponding first and second cryocooler sections in the case of the second aspect. First and second charge pressures may be used in the first and second cryocooler sections, and these may be of the same magnitude of a different magnitude. The first and second pistons may also generate a common fluid pressure amplitude or a different fluid pressure amplitude in their corresponding first and second cryocooler section. The same fluid types or different fluid types (e.g., the same or different working fluid) may be used in the first and second cryocooler sections as well. Any combination of the various options presented in this paragraph may be utilized.

In one embodiment of the second aspect, the compressor moves the first and second pistons at a common frequency. The compressor also may be configured to move the first and second pistons in opposite directions (e.g. to reduce vibration of the compressor). Finally, the compressor of course may move the first and second pistons both at a common frequency and in opposite directions. In each of these instances and in order to enhance the reduction of vibration, the first and second pistons may be disposed in opposing relation (i.e., so as to move along a common axis).

The first and second cryocooler sections may be "thermally connected" in any appropriate manner in the case of the second aspect. Consider the case where the first cryocooler section includes first and second stages, where the first stage of the first cryocooler section precools the second stage, and where the second cryocooler section has a single pulse tube arrangement. The second cryocooler section may not only provide cooling to a particular cooling load, but may also provide precooling for the first cryocooler section.

There are a number of advantages associated with the arrangement contemplated by the second aspect. Any number of parameters may be independently selected in relation to both the first and second cryocooler sections to achieve a desired result. For instance, the first cryocooler section may be operated so as to provide cooling over a first temperature range (including both a single temperature, but more likely over a range of temperatures) and the second cryocooler section may be operated so as to provide cooling over a second temperature range (including both a single temperature, but more likely a range of temperatures) that is different from the first temperature range. In one embodiment, the first cryocooler section provides cooling to a lower temperature than the second cryocooler section (e.g., the first cryocooler section may provide cooling at a lower temperature to a cooling load than the second cryocooler section provides cooling to a different cooling load). The second cryocooler section also may be operated at a higher fluid charge pressure than the first cryocooler section, for instance such that both the first and second cryocooler sections may operate at a more desired efficiency. The flexibility provided by using this type of "split compressor" may be applicable to multi-section cryocoolers of any appropriate kind.

DETAILED DESCRIPTION OF THE INVENTION

Figure 1:
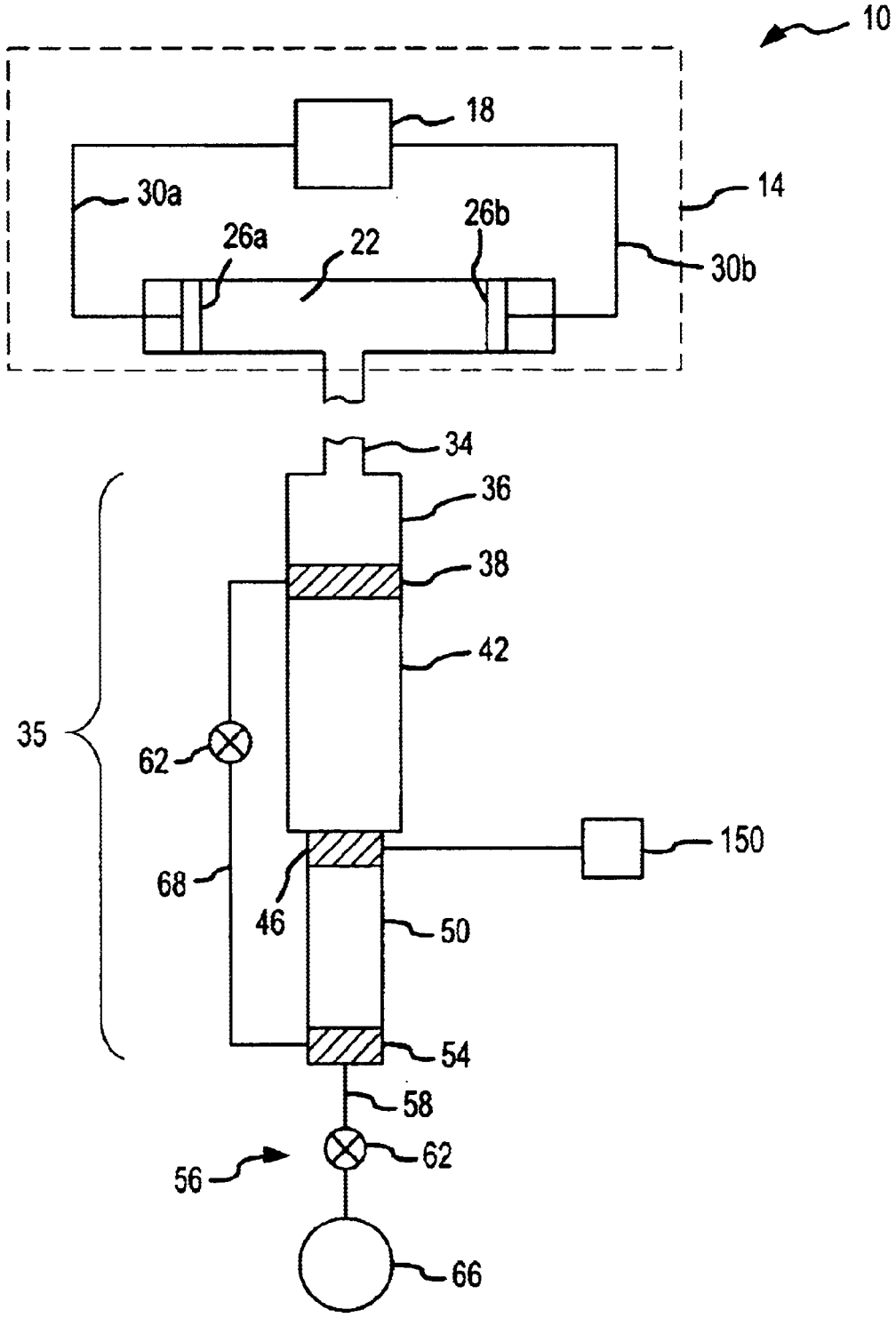
FIG.1 (PRIOR ART)
FIG. 1 is a schematic of one embodiment of a prior art, single stage, pulse tube cryocooler.

One embodiment of a prior art, single stage pulse tube cryocooler is illustrated in FIG. 1 and is identified by reference 10. Components of the pulse tube cryocooler 10 include a compressor 14, a single pulse tube stage 35 that is fluidly interconnected with the compressor 14, and a flow impedance system 56 that is fluidly interconnected with the pulse tube stage 35. Generally, the single pulse tube stage 35 is located in a flowpath between the compressor 14 and the flow impedance system 56.

The pulse tube stage 35 includes a tube 36 that is fluidly interconnected with the output from the compressor 14 by a transfer line 34 of any appropriate configuration/size/type; a regenerator 42 that is fluidly interconnected with the tube 36; a heat exchanger 38 that is associated with one end of the regenerator 42 (commonly referred to as the hot end heat exchanger, or aftercooler 38); a heat exchanger 46 that is associated with the opposite end of the regenerator 42 (commonly referred to as the cold end heat exchanger, or acceptor 46); a pulse tube 50 that is fluidly interconnected with the regenerator 42 and having one end associated with the cold end heat exchanger 46; and a heat exchanger 54 that is associated with an end of the pulse tube 50 that is opposite that end which interfaces with the cold end heat exchanger 46 (commonly referred to as the pulse tube or warm end heat exchanger 54). Generally, the pulse tube cryocooler 10 uses the compression and expansion of an appropriate fluid that is typically compressible (e.g., hydrogen gas, helium gas, neon gas, nitrogen gas) within the single pulse tube stage 35 to provide a cooling function. In this regard, the hot end heat exchanger 38 and the pulse tube heat exchanger 54 are typically characterized as being of a hot or warm temperature (and thereby identified by a similar cross-hatching), while the cold end heat exchanger 46 is of a comparatively colder temperature and is thereby identified by a different cross-hatching. A cooling load 150 (e.g., a device whose temperature is being controlled at least in part by the pulse tube cryocooler 10) is thermally interconnected with the cold end heat exchanger 46 in any appropriate manner (e.g., direct thermal contact) so that the pulse tube cryocooler 10 can remove heat from the cooling load 150.

Details regarding the various components of the pulse tube cryocooler 10 and its operation will now be addressed. The compressor 14 that is associated with the pulse tube cryocooler 10 of FIG. 1 includes a common control system 18 that is interconnected with a pair of reciprocable pistons 26*a*, 26*b* by a corresponding linkage 30*a*, 30*b*. This common control system 18 will typically be in the form of a common controller or control electronics, which interfaces with one motor for the piston 26*a* and another motor for the piston 26*b*. In any case, these pistons 26*a*, 26*b* move along a common axis and interface with a common compression space 22, that in turn is fluidly interconnected with the transfer line 34 leading to the single pulse tube stage 35. Generally, the control system 18 simultaneously advances the pistons 26*a*, 26*b* through the compression space 22 at the same frequency. However, the pistons 26*a*, 26*b* move through the common compression space 22 in opposite directions for vibration reduction purposes. That is, the pistons 26*a*, 26*b* move alternately toward each other and then away from each other. The cryocooler 10 is charged to a desired pressure (i.e., its charge pressure) and is then sealed, such that operation of the pistons 26*a*, 26*b* provides an oscillating pressure amplitude within the pulse tube stage 35.

Operation of the compressor 14 generates a pressure oscillation within the pulse tube stage 35, which in turn causes an alternating mass flow within the pulse tube stage 35. This pressure oscillation and alternating mass flow is a pressure/volume (PV) work, which allows a fluid within the regenerator 42 to remove heat from the cooling load 150. Heat is removed from the cooling load 150 through the cold end heat exchanger 46, and is ultimately "dumped" into the hot end heat exchanger 54 by work flow toward the hot end heat exchanger 54, where heat is rejected to an appropriate heat sink.

The regenerator 42 is in effect a passive heat storage element that may be of any appropriate configuration/size/type. For instance, the regenerator 42 may be in the form of a porous solid (e.g., plurality of parallel plates with a plurality of holes extending therethrough; a stack of screens; a matrix of fibers; a bed of spheres). The regenerator 42 also provides at least some degree of thermal isolation between the hot end heat exchanger 38 and the cold end heat exchanger 46.

The pulse tube 50 of the pulse tube stage 35 is located between the regenerator 42 and the flow impedance system 56, and is fluidly interconnected with both of these components. The flow impedance system 56 is fluidly interconnected with the pulse tube 50 by a fluid line 58 of any appropriate configuration/size/type. Generally, the flow impedance system 56 provides a certain resistance to a mass flow through the pulse tube stage 35. The pulse tube 50 provides a volume into which a mass flow may be directed to dissipate power/work in the form of heat through the pulse tube heat exchanger 54. The pulse tube 50 may be of any appropriate configuration/size/type, but will typically be in the form of a thin-walled tube having a relatively low thermal conductivity (e.g., a stainless steel or titanium alloy tube). One end of the pulse tube 50 is located at the cold end heat exchanger 46, while its opposite end is located at the pulse tube heat exchanger 54. Because of the thermodynamics associated with the pulse tube cryocooler 10, some of the above-noted PV work usually will be rejected as heat through the pulse tube heat exchanger 54 as noted. At least some degree of thermal isolation exists between the higher temperature pulse tube heat exchanger 54 and the lower temperature cold end heat exchanger 46.

The flow impedance system 56 associated with the pulse tube cryocooler 10 of FIG. 1 includes a flow impedance device 62 and a reservoir 66. The reservoir 66 is fluidly interconnected with the end of the pulse tube 50 having the pulse tube heat exchanger 54. The flow impedance device 62 is disposed within the fluid line 58 between the reservoir 66 and the pulse tube heat exchanger 54. Generally, the flow impedance device 62 provides a flow impedance in relation to the operation of the pulse tube stage 35. Pressure oscillations are generated within the tube 36, regenerator 42, and pulse tube 50 by the movement of the pistons 26*a*, 26*b* of the compressor 14 on one end of the pulse tube cryocooler 10. These pressure oscillations are opposed by the flow resistance provided by the flow impedance device 62 at the opposite end of the pulse tube cryocooler 10. The reservoir 66 allows for a certain mass flow to continue down through the pulse tube 50 to have heat removed therefrom by the pulse tube heat exchanger 54 as noted above. Any appropriate configuration may be used for the flow impedance device 62 (e.g., an orifice, valve, porous plug, inertance tube, vortex tube).

The pulse tube heat exchanger 54 and the hot end heat exchanger 38 of the pulse tube stage 35 may be fluidly connected by a fluid line 68 of any appropriate configuration/size/type. A flow impedance device 62 of the above-noted type is also included within the fluid line 68 to allow for adjustment of a fluid flow from the pulse tube heat exchanger 54 to the hot end heat exchanger 38. Fluid flow between the hot heat exchanger 38 and the pulse tube heat exchanger 54 via the fluid line 68 enhances one or more aspects of the operation of the cryocooler 10 by allowing some of the fluid to bypass the regenerator 42 and the pulse tube 50. This fluid flow through the fluid line 68 is part of the closed system of the cryocooler 10.

How the pulse tube cryocooler 10 operates will now be summarized. Generally, advancement of the pistons 26*a*, 26*b* alternately toward each other and then away from each other generates pressure oscillations within the closed volume of the pulse tube cryocooler 10 that is used to provide a desired cooling effect. The pistons 26*a*, 26*b* of the compressor 14 move toward each other via the control system 18 and their corresponding linkage 30*a*, 30*b* (a compression stroke). The compressible fluid within the tube 36 responds to this movement of the pistons 26*a*, 26*b* first by being compressed and then by being translated in the direction of the pulse tube 50. Some of the energy applied to the system at this time is absorbed and dissipated at the hot end heat exchanger 38. Translation of the fluid compressed by the pistons 26*a*, 26*b* is opposed by the flow impedance device 62. Because of the flow resistance posed by the flow impedance device 62, translation of the fluid ultimately halts and the fluid expands. As a consequence of this expansion, the fluid cools and the cold end heat exchanger 46 absorbs thermal energy from the surrounding environment, thereby imparting a cooling effect. Energy is dissipated in the flow impedance device 62 and removed at the pulse tube heat exchanger 54. The pulse tube 50 is an open tube filled with fluid that transmits work from the cold end heat exchanger 46 to the flow impedance device 62, while thermally insulating the cold end heat exchanger 46 from the pulse tube heat exchanger 54. Therefore, the pulse tube 50 in effect acts like a gas piston, insulating the cold end heat exchanger 46 from the pulse tube heat exchanger 54. The flow impedance device 62 dissipates power at the pulse tube heat exchanger 54, and this dissipated power represents the gross cooling power of the pulse tube cryocooler 10.

If the volume of the reservoir 66 is sufficiently large (that is, if it has a large enough compliance, a gas analogy to electrical capacitance), the velocity of fluid at the warm end of the pulse tube 50 and the pressure oscillations will be in phase, and the flow impedance device 62 will perform as a fluid equivalent to a simple resistor of an analogous electrical system. If, however, the volume of the reservoir 66 is small, the velocity of the fluid will lead the pressure of the fluid by some phase angle. Optimum cooler performance usually has the fluid pressure leading the velocity by about 45° at the cold end heat exchanger 46.

Based upon the foregoing, it should be appreciated that the net result of the operation of the pulse tube cryocooler 10 is a transfer of heat from the cold end heat exchanger 46 to the hot end heat exchanger 38 of the pulse tube stage 35. This same general cycle is repeated by continued operation of the compressor 14 and generally in accordance with the foregoing.

Figure 2:
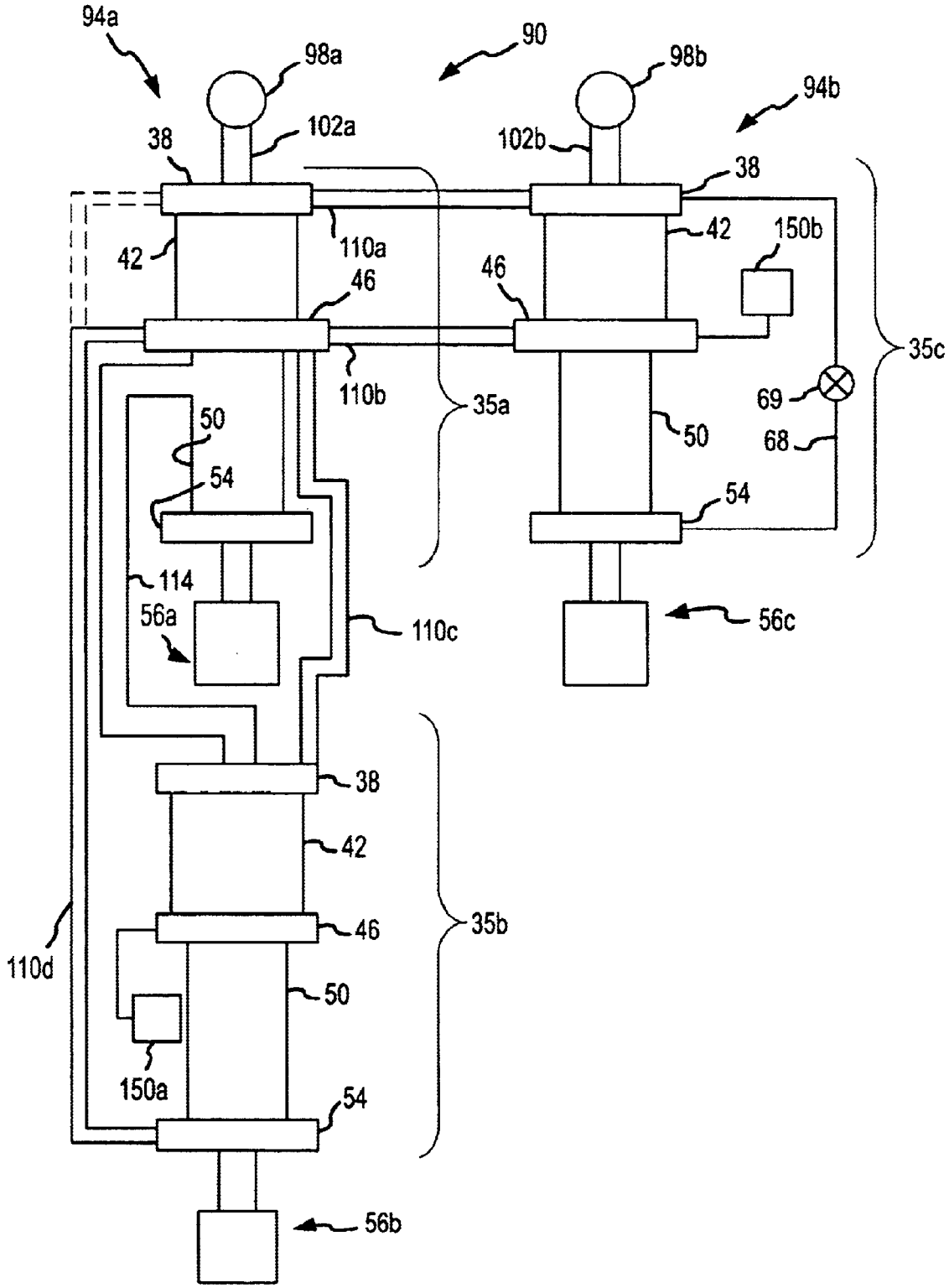
FIG. 2 is a schematic of one embodiment of a pulse tube cryocooler with multiple pressure oscillators for multiple cryocooler sections that are each a closed system, all in accordance with one or more principles of the present invention.

One embodiment of pulse tube cryocooler having separate pressure oscillation sources, as well as multiple cryocooler sections or different "sides", is illustrated in FIG. 2 and is identified by reference 90. Two cryocooler sections 94*a*, 94*b* are used by the pulse tube cryocooler 90 in the illustrated embodiment, and the same are fluidly isolated from each other (i.e., both the first cryocooler section 94*a* and the second cryocooler section 94 are closed systems). A first pressure oscillator 98*a* is associated with the first cryocooler section 94*a*. Similarly, a second pressure oscillator 98*b* is associated with a second cryocooler section 94*b*. The first pressure oscillator 98*a* and the second pressure oscillator 98*b* are thereby fluidly isolated from each other. That is, the first pressure oscillator 98*a* does not interact with fluid in the second cryocooler section 94*b*, nor does the second pressure oscillator 98*b* interact with fluid in the first cryocooler section 94*a*.

Any appropriate number of cryocooler sections 98 could be utilized by the pulse tube cryocooler 90 of FIG. 2. Moreover, the various heat exchangers that are utilized by the cryocooler 90 may be of any appropriate type/configuration. Each cryocooler section 94 utilized by the pulse tube cryocooler 90 will generally have at least one pulse tube stage. The various pulse tube stages that are used by the pulse tube cryocooler 90 of FIG. 2 are therefore identified by a common reference numeral 35 since the same are illustrated as being of the same configuration and operate the same as the pulse tube stage 35 discussed above in relation to FIG. 1. However, "a", "b", and "c" designations are utilized in combination with reference numeral 35 in the FIG. 2 embodiment for ease of cross-referencing the various different pulse tube stages utilized by the pulse tube cryocooler 90. The tube 36 is not illustrated in relation to any of the pulse tube stages 35*a–c* in FIG. 2, although the same may be used in the manner discussed above in relation to FIG. 1.

As noted above, the first pressure oscillator 98*a* is associated with the first cryocooler section 94*a*, while the second pressure oscillator 98*b* is associated with the second cryocooler section 94*b*. Both the first pressure oscillator 98*a* and the second pressure oscillator 98*b* may be of any appropriate configuration/size/type. One option is for the first and second pressure oscillators 98*a*, 98*b* each to be at least generally in the form of the compressor 14 that was discussed above in relation to the cryocooler 10 of FIG. 1. In this case the pulse tube cryocooler 90 would utilize a pair of opposing piston compressors. Another and more preferred option is for the first and second pressure oscillators 98*a*, 98*b* to each be part of the same "split flow" compressor 206 that will be discussed in more detail below in relation to the cryocooler 202 of FIG. 3. Specifically, the first pressure oscillator 98*a* may be in the form of the compression space 214*a*, piston 218*a*, linkage 222*a*, and the control system 210 of the compressor 206 illustrated in FIG. 3. Similarly, the second pressure oscillator 98*b* may be in the form of the compression space 214*b*, the piston 218*b*, the linkage 222*b*, and the control system 210 of the compressor 206 illustrated in FIG. 3.

There are a number of important characterizations in relation to the cryocooler sections 94*a*, 94*b*. One is that the pressure oscillators 98*a*, 98*b* are not fluidly connected, or stated another way the first pressure oscillator 98*a* is fluidly isolated from the second pressure oscillator 98*b*. Stated yet another way, the cryocooler sections 94*a*, 94*b* are fluidly isolated from each other. Therefore, the first and second cryocooler sections 94*a*, 94*b*, respectively, may utilize the same fluid type or different fluid types, the same charge pressure or a different charge pressure, or any combination thereof. Another is that that the operation of the first pressure oscillator 98*a* is at least not totally dependent upon the operation of the second pressure oscillator 98*b*, and vice versa, in the case of the pulse tube cryocooler 90. For instance, the first pressure oscillator 98*a* may be operated to generate a pressure amplitude that is different from the pressure amplitude that is generated by the second pressure oscillator 98*b* in the cryocooler section 94*b*, and further the first pressure oscillator 98*a* and the second pressure oscillator 98*b* may be operated at independently selectable pressure oscillation frequencies. Even though the first cryocooler section 94*a* will likely be operated differently in at least some respect from the second cryocooler section 94*b* in relation to their respective working fluids, charge pressures, oscillating pressure amplitudes, and pressure oscillation frequencies, it should be appreciated that the first and second cryocooler sections 94*a*, 94*b* could use the same working fluid, the same charge pressure, the same oscillating pressure amplitudes, and the same pressure oscillation frequency as well.

The first pulse tube stage 35*a* of the first cryocooler section 94*a* is disposed between the first pressure oscillator 98*a* and the flow impedance system 56*a*. The first pressure oscillator 98*a* is fluidly interconnected with the first pulse tube stage 35*a* by a first transfer line 102*a* of any appropriate configuration/size/type. The flow impedance system 56*a* fluidly interfaces with the opposite end of the first pulse tube stage 35*a* and may be of any appropriate type, including in accordance with the discussion presented above in relation to the flow impedance system 56. It should be appreciated that a fluid line 68 may extend between the pulse tube heat exchanger 54 of the first pulse tube stage 35*a* and the hot end heat exchanger 38 of the first pulse tube stage 35*a*, and be part of the closed system of the first cryocooler section 94*a* (not shown). In addition, a flow impedance device 62 may be included in this particular fluid line 68 to control the fluid flow from the pulse tube heat exchanger 54 of the first pulse stage 35*a* to the hot end heat exchanger 38 of the first pulse tube stage 35*a*.

The hot end heat exchanger 38 of the first pulse tube stage 35*a* of the first cryocooler section 94*a* is thermally interconnected with the hot end heat exchanger 38 of the first pulse tube stage 35*c* of the second cryocooler section 94*b* by an appropriate heat transfer link 110*a* (e.g., in direct thermal contact). Similarly, the cold end heat exchanger 46 of the first pulse tube stage 35*a* of the first cryocooler section 94*a* is thermally interconnected with the cold end heat exchanger 46 of the first pulse tube stage 35*c* of the second cryocooler section 94*b* by an appropriate heat transfer link 110*b*. Incorporating both of the heat transfer links 110*a*, 110*b* enhances one or more aspects of the operation of the cryocooler 90. Although the heat transfer links 110*a*, 110*b* will typically be through conductive heat transfer (e.g., by being mounted on a common flange, plate, or the like; by being connected by a copper rope), convective heat transfer techniques or a combination of convective and conductive heat transfer techniques could be utilized as well.

The second pulse tube stage 35*b* of the first cryocooler section 94*a* is likewise disposed between the first pressure oscillator 98*a* and the flow impedance system 56*b*. As such, the first pulse tube stage 35*a* and the second pulse tube stage 35*b* are at a common charge pressure. The first pulse tube stage 35*a*, the second pulse tube stage 35*b*, the first pressure oscillator 98*a*, and the flow impedance systems 56*a*, 56*b* are part of a closed system. The first pressure oscillator 98*a* is fluidly interconnected with the second pulse tube stage 35*b* at the cold end of the pulse tube 50 of the first pulse tube stage 35*a*. The flow impedance system 56*b* fluidly interfaces with the opposite end of the second pulse tube stage 35*b* and may be of any appropriate type, including without limitation in accordance with the discussion presented above in relation to the flow impedance system 56. It should be appreciated that a fluid line 68 may extend between the pulse tube heat exchanger 54 of the second pulse tube stage 35*b* and either the cold end heat exchanger 46 of the first pulse tube stage 35*a* or the hot end heat exchanger 38 of the first pulse tube stage 35*a*, and be part of the closed system of the first cryocooler section 94*a* (not shown). In addition, a flow impedance device 62 may be included in this particular fluid line 68 to control the flow therethrough.

The hot end heat exchanger 38 of the second pulse tube stage 35*b* is thermally interconnected with the cold end heat exchanger 46 of the first pulse tube stage 35*a* by an appropriate heat transfer link 110*c*. Similarly, the pulse tube heat exchanger 54 of the second pulse tube stage 35*b* is thermally interconnected with either the cold end heat exchanger 46 of the first pulse tube stage 35*a* or the hot end heat exchanger 38 of the first pulse tube stage 35*a* (shown by dashed lines in FIG. 2) by an appropriate heat transfer link 110*d*. Incorporating both of the heat transfer links 110*c*, 110*d* enhances one or more aspects of the operation of the cryocooler 90. Although the heat transfer links 110*c*, 110*d* will typically be through conductive heat transfer, convective heat transfer techniques or a combination of convective and conductive heat transfer techniques could be utilized as well.

The first pulse tube stage 35*c* of the second cryocooler section 94*b* is disposed between the second pressure oscillator 98*b* and the flow impedance system 56*c*, which are all part of a closed system. The second pressure oscillator 98*b* is fluidly interconnected with the first pulse tube stage 35*c* by a first transfer line 102*b* of any appropriate configuration/size/type. The flow impedance system 56*c* fluidly interfaces with the opposite end of the first pulse tube stage 35*c* and may be of any appropriate type, including in accordance with the discussion presented above in relation to the flow impedance system 56. It should be appreciated that a fluid line 68 may extend between the pulse tube heat exchanger 54 and the hot end heat exchanger 38 in the first pulse tube stage 35*c*, and be part of the closed system of the second cryocooler section 94*b*. In addition, a flow impedance device 62 may be included in this particular fluid line 68 to control the fluid flow from the pulse tube heat exchanger 54 to the hot end heat exchanger 38.

Based upon the foregoing, it should be appreciated that the pulse tube cryocooler 90 provides a number of advantages. The first cryocooler section 94*a* may be operated in a manner that increases the operating efficiency of the first cryocooler section 94*a* (e.g., its heat transfer efficiency), while the second cryocooler section 94*b* may be operated in a different manner that increases the operating efficiency of the second cryocooler section 94*b* (e.g., its heat transfer efficiency). For instance, the working fluids for the first cryocooler section 94*a* and the second cryocooler section 94*b* may be independently established, the charge pressures within the first cryocooler section 94*a* and the second cryocooler section 94*b* may be independently established, the frequency of the pressure pulses generated by each of the first pressure oscillator 98*a* and the second pressure oscillator 98*b* may be independently established, the pressure amplitude generated by the first pressure oscillator 98*a* and the second pressure oscillator 98*b* in their corresponding cryocooler section 94*a*, 94*b* may be independently established, or any combination thereof. It should also be appreciated that the various pulse tube stages 35 of the cryocooler 90 may be of any appropriate configuration and arranged in any appropriate manner, and still realize the benefits associated with using separate charge pressure sources.

In one embodiment: a cooling load 150*b* is thermally interconnected with the cold end heat exchanger 46 of the first stage 35*c* of the second cryocooler section 94*b* in any appropriate manner; a cooling load 150*a* is thermally interconnected with the cold end heat exchanger 46 of the second stage 35*b* of the first cryocooler section 94*a* in any appropriate manner; and a lower charge pressure exists within the first cryocooler section 94*a* compared to the charge pressure in the first stage 35*c* of the second cryocooler section 94*b*. The cooling provided at the cold end heat exchanger 46 of the first stage 35*c* of the second cryocooler section 94*b* may be at one temperature or over one temperature range, while the cooling provided at the cold end heat exchanger 46 of the second stage 35*b* of the first cryocooler section 94*a* may be at a lower temperature or over a lower temperature range. Allowing the second cryocooler section 94*b* to operate at a higher charge pressure than utilized by the first cryocooler section 94*a* may allow both sections 94*a*, 94*b* to operate more efficiently.

Figure 3:
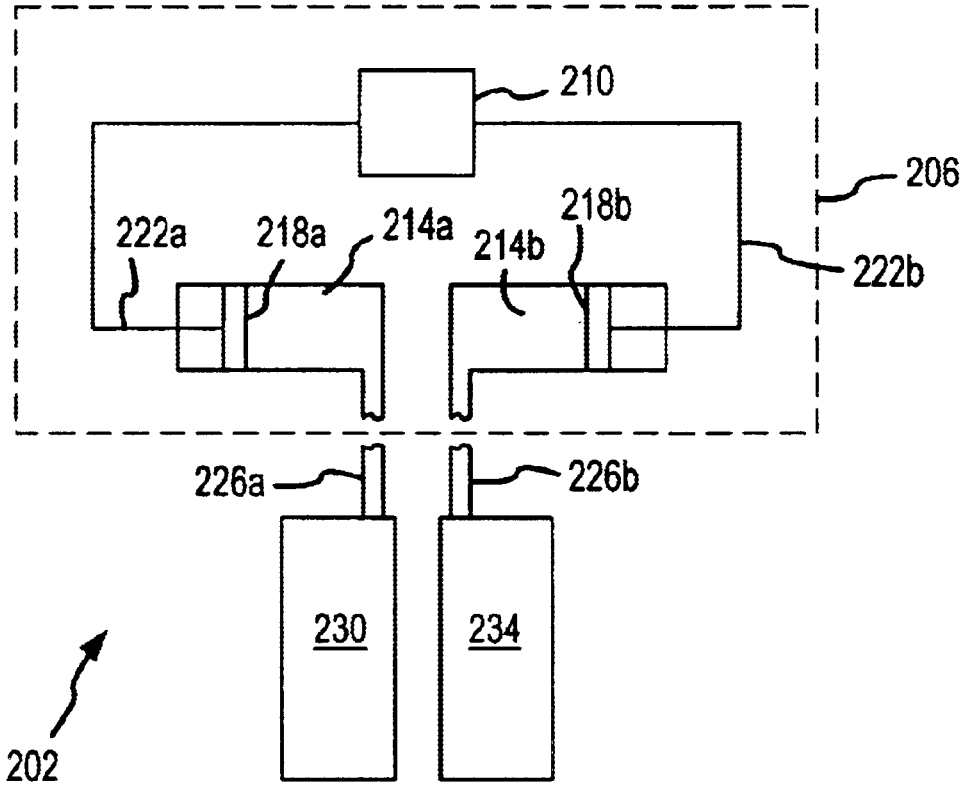
FIG. 3 is a schematic of one embodiment of a multiple section cryocooler with multiple pressure oscillators in the form of a "split compressor" configuration for multiple cryocooler sections that are each a closed system, all in accordance with one or more principles of the present invention.

Another embodiment of a cryocooler that utilizes multiple pressure oscillators is illustrated in FIG. 3 and is identified by reference numeral 202. Two cryocooler sections 230, 234 are used by the cryocooler 202 in the illustrated embodiment, and the same are fluidly isolated from each other. Each of the cryocooler sections 230, 234 may be of any appropriate configuration/size/type. For instance, each of the cryocooler sections 230, 234 may be of the pulse tube-type (e.g. one or more pulse tube stages 35), may be of the Stirling-type (e.g., one or more Stirling stages), or a hybrid combination of pulse tube and Stirling stages. What is of principal importance in relation to the FIG. 3 embodiment is that the compressor 206 provides a pressure oscillation to both cryocooler sections 230, 234 other than through a common compression space.

The compressor 206 used by the cryocooler 202 includes an appropriate control system 210. This control system 210 is at least operatively interconnected with a pair of pistons 218*a*, 218*b* by a corresponding linkage 222*a*, 222*b*. This common control system 210 may be in the form of a common controller or control electronics that at least operatively interfaces with each of the 218*a*, 218*b*. For instance, this common control system 210 may interface with a first motor for moving the first piston 218*a*, as well as with a second motor for moving the second piston 218*b*. In any case, the pistons 218*a*, 218*b* are disposed in opposing relation, or stated another way are disposed for movement along a common axis.

Each piston 218*a*, 218*b* has its own corresponding compression space 214*a*, 214*b* (i.e., the compression space 214*a* is fluidly isolated from the compression space 214*b*). That is, unlike the compressor 14 used by the pulse tube cryocooler 10 of FIG. 1, the pistons 218*a*, 218*b* do not simultaneously act on the same compression space or the same working fluid. Instead, the compression space 214*a* is fluidly interconnected with the first cryocooler section 230 by a transfer line 226*a* of any appropriate configuration/size/type. Similarly, the compression space 214*b* is fluidly interconnected with the cryocooler section 234 by a transfer line 226*b* of any appropriate configuration/size/type. The cryocooler sections 230, 234 are thereby fluidly isolated from each other as noted, in that the cryocooler section 234 does not fluidly interconnect with the compression space 214*a*, and further in that the cryocooler section 230 does not fluidly interconnect with the compression space 214*b*. Stated another way, the compression space 214*a* is fluidly isolated from the compression space 214*b*. As such, the piston 218*a* does not interact with fluid in the compression space 214*b* or the cryocooler section 234. Similarly, the piston 218*b* does not interact with fluid in the compression space 214*a* or the cryocooler section 230. Therefore, both the working fluid and charge pressure within the first cryocooler section 230 and second cryocooler section 234 each may be independently selected. In one embodiment, only a single piston (piston 214*a*) provides the pressure oscillation for the cryocooler section 230, and only a single piston (piston 214*b*) provides the pressure oscillation for the cryocooler section 234. Preferably, these pistons 214*a*, 214*b* are again disposed in opposing relation.

The control system 210 simultaneously moves both pistons 218*a*, 218*b* through their corresponding compression space 214*a*, 214*b*. Preferably, the control system 210 moves the pistons 218*a*, 218*b* in opposite directions for vibration reduction purposes. Stated another way, the control system 210 operates both pistons 218*a*, 218*b* at the same frequency, but 180° out of phase with each other. In one embodiment, the pistons 218*a*, 218*b* are advanced toward each other during their respective compression strokes, and the pistons 218*a*, 218*b* move away from each other during their respective expansion strokes. In another embodiment, the pistons 218*a*, 218*b* are advanced away from each other during their respective compression strokes, and the pistons 218*a*, 281*b* are advanced toward each other during their respective expansion strokes (not shown).

It should be appreciated that the cryocooler 202 of FIG. 3 provides at least some of the same types of advantages that were discussed above in relation to the pulse tube cryocooler 90 of FIG. 2 in relation to having at least some degree of independence. The fluids within the cryocooler selections 230, 234 may be independently selected, the same or a different charge pressure may be utilized by the cryocooler sections 230, 234 (and independently selected as well), and the same or a different pressure amplitude may be selected for the cryocooler sections 230, 234. If vibrations are not a concern, it may be possible for the linkages 222*a*, 222*b* to be adjusted to operate each piston 218*a*, 218*b* at a different frequency. However, operation of the pistons 218*a*, 218*b* in the above-noted manner for vibration reduction purposes is the preferred configuration.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A cryocooler, comprising:

a first cryocooler section comprising first and second stages, wherein said first and second stages each comprise at least one pulse tube;

a first pressure oscillator fluidly connected with said first cryocooler section;

a second cryocooler section comprising a second cryocooler section first stage, that in turn comprises at least one pulse tube; and a second pressure oscillator fluidly interconnected with said second cryocooler section thermally coupled to said first cryogenic section and wherein said first and second cryocooler sections are fluidly isolated from each other.

2. A cryocooler, as claimed in claim 1, wherein:

said first stage of said first cryocooler section further comprises a first regenerator, a first pulse tube, and first, second, and third heat exchangers, wherein said first pressure oscillator is fluidly interconnected with said first stage, said first heat exchanger is associated with a first part of said first regenerator, said second heat exchanger is associated with both a second part of said first regenerator and a first part of said first pulse tube, and said third heat exchanger is associated with a second part of said first pulse tube;

said first stage of said first cryocooler section precools said second stage of said first cryocooler section, wherein said second stage comprises a second regenerator, a second pulse tube, and fourth, fifth, and sixth heat exchangers, wherein said first pressure oscillator is also fluidly interconnected with said second stage, said fourth heat exchanger is associated with a first part of said second regenerator, said fifth heat exchanger is associated with both a second part of said second regenerator and a first part of said second pulse tube, and said sixth heat exchanger is associated with a second part of said second pulse tube; and said second cryocooler section first stage comprises a third regenerator, a third pulse tube, and seventh, eighth, and ninth heat exchangers, wherein said second pressure oscillator is fluidly interconnected with the second cryocooler section first stage, said seventh heat exchanger is associated with a first part of said third regenerator, said eighth heat exchanger is associated with both a second part of said third regenerator and a first part of said third pulse tube, and said ninth heat exchanger is associated with a second part of said third pulse tube.

3. A cryocooler, as claimed in claim 2, wherein:

said first heat exchanger of said first stage of said first cryocooler section and said seventh heat exchanger of said second cryocooler section first stage are thermally connected by a heat transfer link.

4. A cryocooler, as claimed in claim 2, wherein:

said second heat exchanger of said first stage of said first cryocooler section and said eighth heat exchanger of said second cryocooler section first stage are thermally connected by a heat transfer link.

5. A cryocooler, as claimed in claim 4, wherein:

said first heat exchanger of said first stage of said first cryocooler section and said seventh heat exchanger of said second cryocooler section first stage are thermally connected by a heat transfer link.

6. A cryocooler, as claimed in claim 1, wherein:

said first cryocooler section comprises a first charge pressure and said second cryocooler section comprises a second charge pressure, wherein said first and second charge pressures are of the same magnitude.

7. A cryocooler, as claimed in claim 1, wherein:

said first cryocooler section comprises a first charge pressure and said second cryocooler section comprises a second charge pressure that is of a different magnitude than said first charge pressure.

8. A cryocooler, as claimed in claim 1, wherein:

said first pressure oscillator and said second pressure oscillator generate a common fluid pressure amplitude in said first and second cryocooler sections, respectively.

9. A cryocooler, as claimed in claim 1, wherein:

said first pressure oscillator and said second pressure oscillator generate a different fluid pressure amplitude in said first and second cryocooler sections, respectively.

10. A cryocooler, as claimed in claim 1, wherein:

said first and second cryocooler sections utilize a common charge pressure, wherein said first pressure oscillator and said second pressure oscillator generate a different pressure amplitude in said first and second cryocooler sections, respectively.

11. A pulse type tube cryocooler, as claimed in claim 1, wherein:

said first and second cryocooler sections comprise a common type of fluid.

12. A cryocooler, as claimed in claim 1, wherein:

said first and second cryocooler sections comprise first and second fluids, respectively, wherein said first and second fluids are of a different type.

13. A cryocooler, as claimed in claim 1, wherein:

said first and second cryocooler sections comprise first and second fluids, respectively, wherein said first and second cryocooler sections comprise first and second fluid charge pressures, respectively, and wherein said first and second pressure oscillators generate first and second fluid pressure amplitudes, respectively, in said first and second cryocooler sections, respectively, wherein said first and second fluids are selected from the group consisting of a common fluid type and a different fluid type, wherein said first and second charge pressures are selected from the group consisting of same and different magnitudes, and wherein said first and second pressure amplitudes are selected from the group consisting of same and different magnitudes.

14. A cryocooler, as claimed in claim 1, wherein:

said first and second pressure oscillators comprise first and second compressors, respectively.

15. A cryocooler, as claimed in claim 14, wherein:

said first and second compressors run at a common frequency.

16. A cryocooler, as claimed in claim 14, wherein:

said first and second compressors run at different frequencies.

17. A cryocooler, as claimed in claim 1, wherein:

said first and second pressure oscillators comprise a common compressor.

18. A cryocooler, as claimed in claim 1, wherein:

a compressor comprises a common controller, as well as first and second pistons each interconnected with said common controller and disposed within first and second compression spaces, respectively, wherein said first and second compression spaces are fluidly isolated from each other, wherein said first pressure oscillator comprises said first piston and said first compression space, and wherein said second pressure oscillator comprises said second piston and said second compression space.

19. A cryocooler, as claimed in claim 18, wherein:

said controller moves said first and second pistons in opposite directions.

20. A cryocooler, as claimed in claim 1, wherein:

wherein said second cryocooler section first stage comprises means for precooling said first stage of said first cryocooler section.

21. A cryocooler, as claimed in claim 1, wherein:

said second cryocooler section first stage comprises means for precooling at least part of said first cryocooler section.

22. A cryocooler, as claimed in claim 1, wherein:

said first cryocooler section comprises means for providing cooling over a first temperature range and said second cryocooler section comprises means for providing cooling over a second temperature range that is different from said first temperature range.

23. A cryocooler, as claimed in claim 22, wherein:

said first temperature range is lower than said second temperature range.

24. A cryocooler, as claimed in claim 1, wherein:

said first cryocooler section utilizes a lower charge pressure than said second cryocooler section, wherein said first cryocooler section cools to a lower temperature than said second cryocooler section.

25. A cryocooler, comprising:

a first cryocooler section;

a second cryocooler section; and a compressor comprising first and second pistons that are disposed within first and second compression spaces, respectively, wherein said first and second compression spaces are fluidly isolated from each other, wherein said first compression space is fluidly interconnected with said first cryocooler section and is fluidly isolated from said second cryocooler section, and wherein said second compression space is fluidly interconnected with said second cryocooler section and is fluidly isolated from said first cryocooler section.

26. A cryocooler, as claimed in claim 25, wherein:

said first and second cryocooler sections each utilize at least one pulse tube, wherein said first and second cryocooler sections use a different number of said pulse tubes.

27. A cryocooler, as claimed in claim 25, wherein:

said first and second cryocooler sections each utilize at least one pulse tube.

28. A cryocooler, as claimed in claim 25, wherein:

a first stage of said first cryocooler section comprises a first regenerator, a first pulse tube, and first, second, and third heat exchangers, wherein said first compression space is fluidly interconnected with said first stage, said first heat exchanger is associated with a first part of said first regenerator, said second heat exchanger is associated with both a second part of said first regenerator and a first part of said first pulse tube, and said third heat exchanger is associated with a second part of said first pulse tube;

said first stage of said first cryocooler section precools a second stage of said first cryocooler section, wherein said second stage comprises a second regenerator, a second pulse tube, and fourth, fifth, and sixth heat exchangers, wherein said first compression space is also fluidly interconnected with said second stage, said fourth heat exchanger is associated with a first part of said second regenerator, said fifth heat exchanger is associated with both a second part of said second regenerator and a first part of said second pulse tube, and said sixth heat exchanger is associated with a second part of said second pulse tube; and a second cryocooler section first stage of said second cryocooler comprises a third regenerator, a third pulse tube, and seventh, eighth, and ninth heat exchangers, wherein said second compression space is fluidly interconnected with the second cryocooler section first stage, said seventh heat exchanger is associated with a first part of said third regenerator, said eighth heat exchanger is associated with both a second part of said third regenerator and a first part of said third pulse tube, and said ninth heat exchanger is associated with a second part of said third pulse tube.

29. A cryocooler, as claimed in claim 28, wherein:

said first heat exchanger of said first stage of said first cryocooler section and said seventh heat exchanger of said second cryocooler section first stage are thermally connected by a heat transfer link.

30. A cryocooler, as claimed in claim 28, wherein:

said second heat exchanger of said first stage of said first cryocooler section and said eighth heat exchanger of said second cryocooler section first stage are thermally connected by a heat transfer link.

31. A cryocooler, as claimed in claim 30, wherein:

said first heat exchanger of said first stage of said first cryocooler section and said seventh heat exchanger of said second cryocooler section first stage are thermally connected by a heat transfer link.

32. A cryocooler, as claimed in claim 25, wherein:

a first pressure oscillator comprises said first piston and said first compression space, and wherein a second pressure oscillator comprises said second piston and said second compression space.

33. A cryocooler, as claimed in claim 25, wherein:

said first and second cryocooler sections utilize a common charge pressure.

34. A cryocooler, as claimed in claim 25, wherein:

said first and second cryocooler sections utilize different charge pressures.

35. A cryocooler, as claimed in claim 25, wherein:

said first and second cryocooler sections utilize a common fluid pressure amplitude.

36. A cryocooler, as claimed in claim 25, wherein:

said first and second cryocooler sections utilize a different fluid pressure amplitude.

37. A cryocooler, as claimed in claim 25, wherein:

said first and second cryocooler section utilize a common fluid charge pressure and a different fluid pressure amplitude.

38. A pulse type tube cryocooler, as claimed in claim 25, wherein:

said first and second cryocooler sections comprise a common type of fluid.

39. A cryocooler, as claimed in claim 25, wherein:

said first and second cryocooler sections comprise first and second fluids, respectively, wherein said first and second fluids are of a different type.

40. A cryocooler, as claimed in claim 25, wherein:

said first and second cryocooler sections comprise first and second fluids, respectively, and first and second fluid charge pressures, respectively, wherein said first and second pistons generate first and second fluid pressure amplitudes, respectively, in said first and second cryocooler sections, respectively, wherein said first and second fluids are selected from the group consisting of a common fluid type and a different fluid type, wherein said first and charge pressures are selected from the group consisting of same and different magnitudes, and wherein said first and second pressure amplitudes are selected from the group consisting of same and different magnitudes.

41. A cryocooler, as claimed in claim 25, wherein:

said compressor comprises a controller that is at least operatively interconnected with each of said first and second pistons.

42. A cryocooler, as claimed in claim 41, wherein:

said controller moves said first and second pistons at a common frequency.

43. A cryocooler, as claimed in claim 41, wherein:

said controller moves said first and second pistons in opposite directions.

44. A cryocooler, as claimed in claim 43, wherein:

said controller moves said first and second pistons at a common frequency.

45. A cryocooler, as claimed in claim 25, wherein:

said first and second cryocooler sections are thermally connected.

46. A cryocooler, as claimed in claim 25, wherein:

said first cryocooler section comprises first and second stages, and wherein said second cryocooler section comprises means for precooling said first stage of said first cryocooler section.

47. A cryocooler, as claimed in claim 25, wherein:

said second cryocooler section comprises means for precooling at least part of said first cryocooler section.

48. A cryocooler, as claimed in claim 25, wherein:

said first cryocooler section comprises means for providing cooling over a first temperature range and said second cryocooler section comprises means for providing cooling over a second temperature range that is different from said first temperature range.

49. A cryocooler, as claimed in claimed 48, wherein:

said first temperature range is lower than said second temperature range.

50. A cryocooler, as claimed in claim 25, wherein:

said first cryocooler section utilizes a lower charge pressure than said second cryocooler section, wherein said first cryocooler section cools to a lower temperature than said second cryocooler section.

* * * * *

UNITED STATES PATENT AND TRADEMARK OFFICE

CERTIFICATE OF CORRECTION

PATENT NO. : 6,813,892 B1
DATED : November 9, 2004
INVENTOR(S) : Olson et al.

It is certified that error appears in the above-identified patent and that said Letters Patent is hereby corrected as shown below:

Column 16,
Line 34, after the word "section", insert -- thermally coupled to said first cryogenic section and --;
Lines 38-39, delete "thermally coupled to said first cryogenic section and", and insert therefor -- , --.

Column 20,
Line 24, delete "section", insert -- sections --;
Line 44, after the word "and", insert -- second --.

Signed and Sealed this

Twelfth Day of April, 2005

JON W. DUDAS
*Director of the United States Patent and Trademark Office*